United States Patent [19]

Popoff

[11] 4,359,279

[45] Nov. 16, 1982

[54] PHOTOGRAPHIC PROCESSING APPARATUS WITH LIQUID APPLICATION TO BOTH SIDES OF THE PHOTOGRAPHIC MATERIAL

[75] Inventor: Andrew Popoff, Mountain Lakes, N.J.

[73] Assignee: Keuffel & Esser Company, Morristown, N.J.

[21] Appl. No.: 303,797

[22] Filed: Sep. 21, 1981

[51] Int. Cl.[3] ..... G03D 3/02

[52] U.S. Cl. ..... 354/320; 354/325; 118/304; 118/314; 118/410

[58] Field of Search ..... 354/317, 319, 320, 321, 354/322, 325, 318; 134/64 P, 122 P; 118/304, 314, 315, 410, 411

[56] References Cited

U.S. PATENT DOCUMENTS

| | | | |
|---|---|---|---|
| 3,192,846 | 7/1965 | Wright | 134/122 P |
| 3,372,630 | 3/1968 | Schmidt | 354/321 |
| 3,448,720 | 6/1969 | Graham | 118/314 |
| 3,630,213 | 12/1971 | Bruno et al. | 354/318 |
| 3,774,521 | 11/1973 | Beck | 354/317 |
| 3,791,345 | 2/1974 | McCutcheon | 354/319 |

*Primary Examiner*—L. T. Hix
*Assistant Examiner*—Alan Mathews
*Attorney, Agent, or Firm*—Lionel N. White

[57] ABSTRACT

Apparatus for safely transporting a sheet of photographic material through a development or other processing station comprises means for concurrently circulating processing liquid in the form of a plurality of streams both downward onto the sheet and upward from an underlying plate, the latter streams supporting the sheet and providing for the formation of a liquid layer between the plate and the sheet which facilitates the unrestricted passage of the sheet along the processing path. The downwardly projected streams are angled in the direction of sheet travel to provide further impetus to the movement of the sheet.

3 Claims, 6 Drawing Figures

PHOTOGRAPHIC PROCESSING APPARATUS WITH LIQUID APPLICATION TO BOTH SIDES OF THE PHOTOGRAPHIC MATERIAL

BACKGROUND

The present invention relates to apparatus for processing photographic imaging sheet materials, and is particularly useful for developing so-called "wash-off" photographic products generally comprising a base film or sheet having a coating thereon of photographically active composition which upon exposure to light is preferentially removable from the base subsequent to the application of an activator or developing fluid composition.

The processing of these wash-off products to develop latent photographic images may be readily accomplished manually by the simple application of an activator solution in which either the light-exposed or -unexposed areas of the photographic composition are more readily soluble, and then flushing the solublized material from the surface of the base film. During the manual processing of wash-off products the progress of the development and removal of image-defining portions of the coated composition may be visually monitored. More or less agitation of the developer fluid at the surface of the sheet may be effected to ensure a consistent degree of development over the whole of the image sheet. A rinse or flushing of the surface of the sheet material to remove remnants of partially dissolved or softened imaging composition usually finishes the processing; however, activator solution may be reapplied wherever image development is less than complete.

Such manual developing is normally sufficient for limited scale production of wash-off image sheets of small or medium size, such as may be encountered in some graphic art shops. More extensive production, however, of the larger engineering drawings or graphic arts reproductions has made necessary the use of automatic processing equipment which can ensure a consistency of development and composition removal over the entire surface of such expansive photographic sheets. It is in such use for the processing of large scale, high quality wash-off photographic reproductions that the apparatus of the present invention is particularly advantageous.

This apparatus finds utility in the development of photographic materials based on photoresist or phototech compositions, for example those employing various photopolymer resin coatings. The apparatus is, in fact, particularly adapted to the development of graphic arts reproduction material comprising a coated surface which is in part soft and tacky in its end use, for example as an imaged receptor of dry, colored pigments or powders in a process for preparing a colorproofing sheet. In one such process a photoresist material, preferentially solublized by the exposure to imaging light, is removed in a wash-off procedure to yield an underlying image of tacky polymeric material which will ultimately receive and adherently retain a powdered toner or colorant of a desired primary color. This process further includes a second wash-off development step after the application of such dry colorants and thus requires that the processing be not excessively harsh lest the colorant image be damaged or distorted.

The consistency of the development processing of photographic materials is also a prime requisite in the graphic arts industry, particularly in the art of colorproofing where the integrity of screen patterns must be retained throughout the multiple reproductions comprising a single composite surprint proof. Such processing must not only ensure a constant degree of activator or developer concentration level over the entire sheet surface, but must also avoid physical distortion not uncommonly encountered in previously available processing apparatus.

One such system, as described in U.S. Pat. No. 3,630,213, proposed the transport of a photographic sheet material through a pool of activator solution collected in the valley of a sagging transport belt with subsequent removal of dissolved or softened coated material under the force of rinsing sprays. Although in concept this system would avoid physical contacts with the processing photographic composition, it was practically limited in effectiveness due to the uneven distribution and concentration of developing solution over the surface of the image sheet with resulting imbalance in image density. The difficulties normally encountered in maintaining a consistent tracking of transport belt further detracted from the practicality of this developing apparatus. The high velocity laminar flow of developer solution in a system as described in U.S. Pat. No. 3,791,345 also fails to provide a uniform degree of developer activity across the whole of a larger reproduction sheet.

In contrast to photographic sheet processing equipment heretofore available, the apparatus of the present invention provides for maintenance of a constant concentration of developer over the entire surface of the processing sheet material and affords a constant degree of non-mechanical agitation which ensures the loosening and removal of softened or dissolved photographic coating material without danger to delicate retained surface films or previously applied toning colorants. This apparatus further provides a fluid layer transport system which does not rely upon difficulty controlled belts or similar moving surfaces.

SUMMARY

The developing apparatus of the present invention generally comprises a pair of adjacent open tanks over which are suspended, respectively, developing and rinsing transport and fluid application subassemblies. Each such subassembly comprises pairs of vertically disposed transport rollers situated at each end of a flat fountain plate above which extend one or more perforated pipes from which may be cascaded developer or rinsing solution. The pair of roller nips define a path of sheet travel which extends substantially parallel to and slightly above the surface of the plate.

Circulating pumps are provided for each of the tank and subassembly combinations, and provide for solution flow from the tank upward through appropriate piping conduits into and through the spray pipes and fountain plate respectively disposed above and below a sheet of photographic material being transported through the roller nips along the path extending above the fountain plate. The circulating solution flowing about the surface of the photographic material returns by gravity to the tank containing the main body of solution. Each of the developer or rinsing solutions is thus recirculated within its own tank and is continuously applied to the photographic sheet material as it traverses the path through the apparatus.

In order to ensure a continuous and thorough mixing of a processing solution, and thus maintain a uniform concentration of active developing materials, the pumping and fluid delivery system introduces the solution to both ends of the perforated pipes which extend across the width of the image sheet. The uniform application of processing solution to the sheet material is further ensured by the staggered location of the pipe perforations or ports from which the solution flows onto the sheet in a regular pattern covering all portions of its surface.

The plate extending between the roller nips includes one or more enclosed interconnected channels which span substantially the entire width of the plate and communicate by means of a multiplicity of holes or ports with the upper surface of the plate. During operation of the apparatus, a portion of the developing or rinsing fluid being circulated through the system is directed into these channels and exits through the ports as standing fountains of fluid. An image sheet introduced through the first nip of transport rollers traverses the underlying plate and is held out of contact with that plate by the fountain fluid flow until its leading edge reaches the second of the pair of nips which acts in the manner of a wringer to remove excess fluid from the surfaces of the image sheet. In the course of its travel the image sheet is thus at the same time supported by fluid flow from the fountains and immersed in fluid cascading over the whole of its surface from the overhead spray pipes.

Upon passage of the image sheet through the desired sequence of processing sections, it is finally transported to a circulating warm air dryer of any suitable configuration.

DRAWINGS

DESCRIPTION

Figure 1:
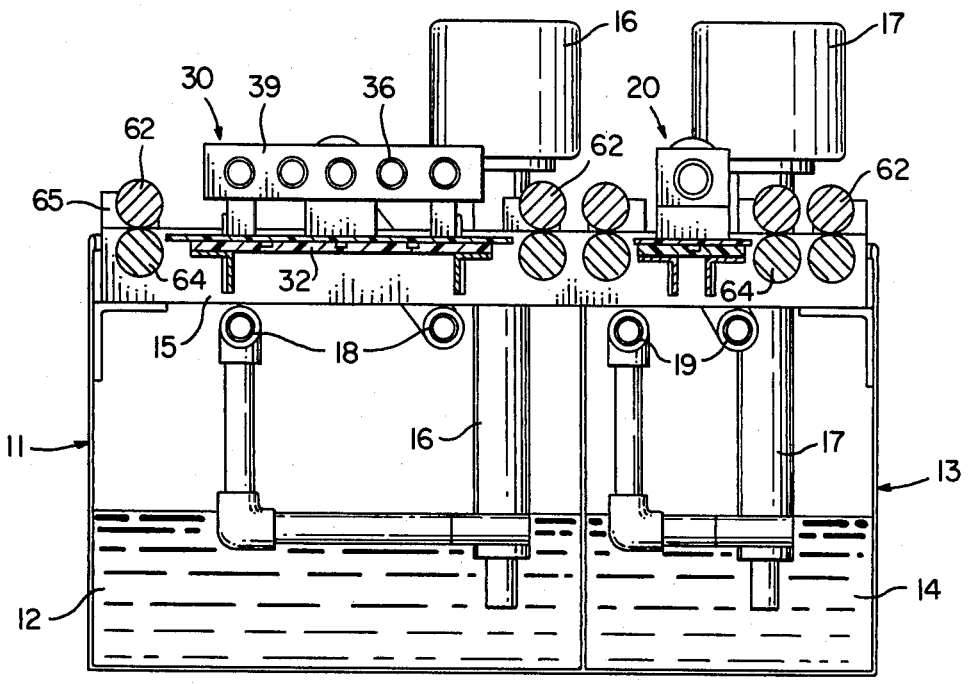
FIG. 1 is an elevational side view, in section, showing the various subassemblies in an embodiment of the apparatus of the present invention.

The general structural arrangement in an embodiment of the developing apparatus of the present invention may be seen in FIG. 1 as comprising a pair of tanks 11, 13 in which supplies of developer and rinsing fluids or solutions 12, 14 are respectively contained. Since the processing fluids may be for the most part corrosive, it is preferred that these tanks be made of resistant materials such as stainless steel or plastic. Beams 15 span the length of the tank arrangement and provide support for transport roll pairs 62, 64, fluid application and transport subassemblies 30, 20, pumps 16, 17 and associated piping 18, 19. The apparatus is completed with a warm air drying section and an enclosing cabinet, neither of which is shown, since they may be of any available configuration and do not constitute a part of the present invention.

As depicted in FIG. 1, the developer subassembly 30 of the apparatus comprises a sheet transport section shown generally as plate 32, and a fluid cascade application section shown generally as manifold 39 and spray pipes 36. These sections may be seen in greater detail in FIGS. 3 and 4, and will be discussed more specifically below. Similarly, rinse subassembly 20 may be seen in greater detail in FIGS. 2 and 5 which respectively depict the side and front elevations of the fluid distribution and transport plate elements of the rinse section 20. Although the developer and rinse subassemblies 30, 20 are shown as comprising five and one spray pipes respectively, any number of such pipes may be employed which will provide sufficient contact of the processing fluid with the photographic sheet material, depending upon the concentration and activity of the fluid and the composition of the photographic coating or coatings involved. Thus, the length of the developer and rinse sections and the speed at which the photographic sheet traverses these sections will be determined in accordance with the parameters of the materials to be processed in the apparatus.

Figure 2:
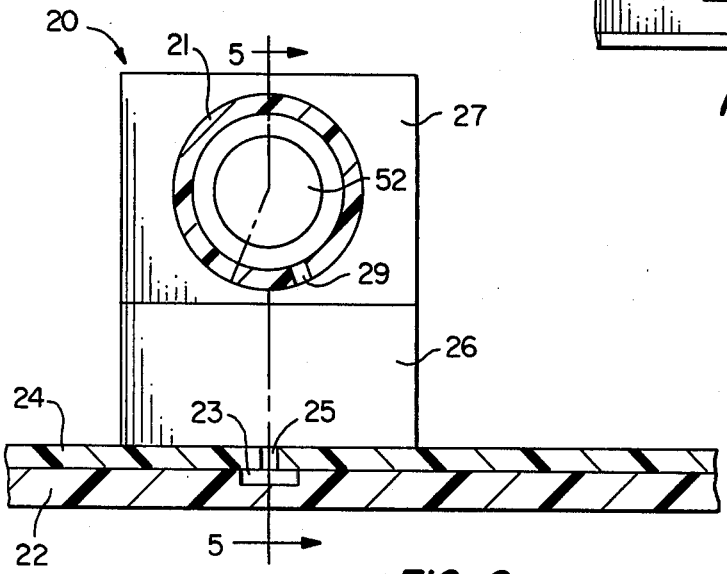
FIG. 2 is an enlarged elevational view, in section taken along 2—2 in FIG. 5, showing a fluid conduit portion of the apparatus.
Figure 3:
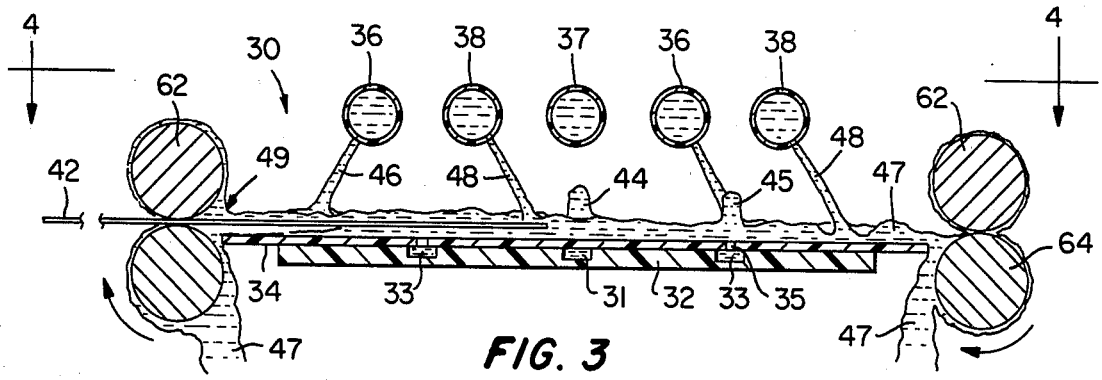
FIG. 3 is an elevational view, in section taken along 3—3 in FIG. 4, showing the sheet transport and fluid flow operation in the apparatus.
Figure 5:
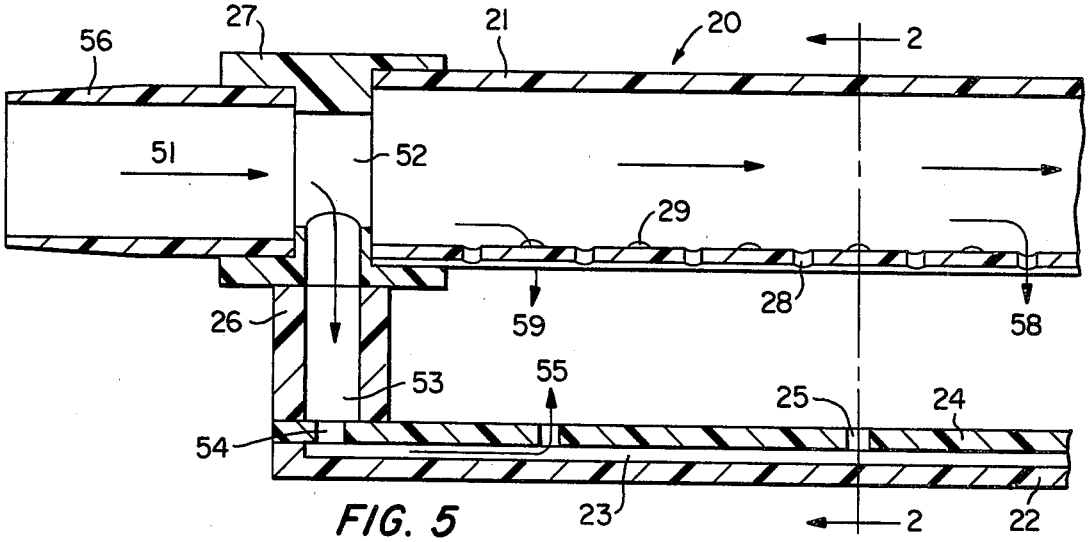
FIG. 5 is an elevational view in section taken along 5—5 in FIG. 2, showing the paths of fluid flow in an application portion of the apparatus.

Considering first the fluid distribution arrangement of rinse section 20 as depicted in FIGS. 2 and 5, it will be seen that in the present embodiment the transport plate comprises a base plate 22 in which is milled a conduit channel 23, and an overlying fountain plate 24 having a plurality of fountain ports 25 located so as to overlie channel 23 when plates 22, 24 are assembled in fluid-tight relationship by means of adhesive or other clamping means (not shown). As will later be seen, a transport plate may comprise any number of interconnected conduit channels 23 and fountain ports 25 depending upon the desires of the manufacturer.

Situated along each edge of fountain plate 24 are support block conduits 26 and attached manifold blocks 27. Suspended between manifold blocks 27 and extending over the width of fountain plate 24 is spray pipe 21 in which are pluralities of spray ports 28, 29 arranged to direct the flow of circulating fluid generally downward onto the surface of fountain plate 24 or an overlying photographically imaged sheet. As is preferred, when a single spray pipe is employed, ports 28, 29 are arranged in staggered or alternating sequence and are directed at angles from the perpendicular so as to provide the effective uniform and active fluid flow at the surface of the image sheet.

Piping 19 carrying rinse fluid 14 from circulating pump 17 is connected to each of the pair of manifolds 27 by means of coupling connectors 56 and thus, with operation of pump 17, supplies rinse fluid evenly to each side of subassembly 20. As can be seen in FIG. 5, the course of fluid flow is represented by arrows as stream 51 entering through connector 56 and being distributed through manifold T-bore 52 to pass into spray pipe 21, as well as into support conduit bore 53 and fountain plate inlet bore 54 and thence into conduit channel 23. From the spray pipe and conduit channel the fluid exits through ports 25, 28, 29 as fountain streams 55 and spray cascade streams 58, 59 respectively. The effect and action of these streams upon an image sheet being processed may be more readily seen in connection with the operation of developer section 30 depicted in FIGS. 3 and 4.

In a manner similar to that described with respect to rinse subassembly 20, the transport plate of developer subassembly 30 comprises base plate 32 having a plurality of interconnected milled conduit channels 31, 33, and fountain plate 34 with fountain ports 35 overlying these channels. Fountain plate 34 extends across the width of the apparatus within the confines of tank 11, and along the length of the span between developer section transport rollers 62, 64. A manifold 39 is located at each edge of fountain plate 34 to accommodate and support pipes 36, 37, 38 in parallel position above the fountain plate. But for the plurality of spray pipes and base plate conduit channels, and a pair of pumps 16, of which one only is shown, to accommodate the extra fluid flow, distribution of developer solution is similar to that described with respect to the rinse fluid of subassembly 20. Thus, developer fluid 12 is taken up by pumps 16 and fed via pumping 18 to manifolds 39 and the ends of nonperforated pipe 37 which acts in the present embodiment as an equalizing distributor of developer fluid between manifolds 39 from the T-bores of which are supplied spray pipes 36, 38 and base plate channels 31, 33.

Figure 4:
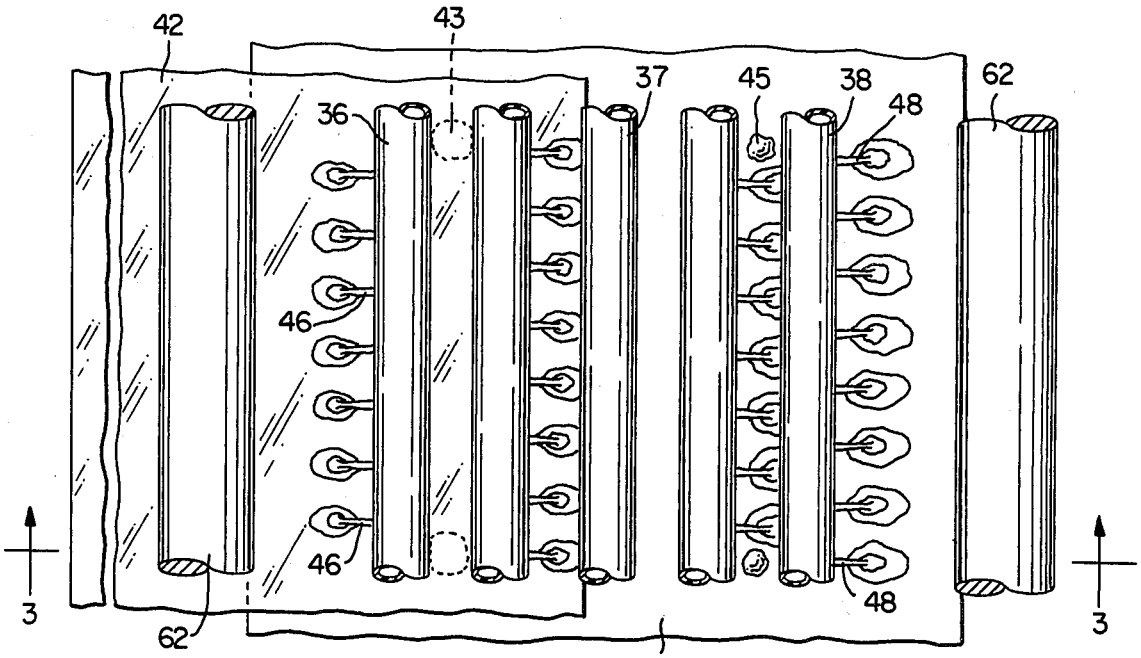
FIG. 4 is a plan view, taken along 4—4 in FIG. 3, of a portion of the apparatus showing the arrangement and operation of fluid flow and sheet transport.

As seen more clearly in FIG. 4, the spray ports of pipes 36, 38 are arranged in staggered or alternating sequence along their length in order that cascading streams 46, 48 will, in combination, uniformly cover the surface of image sheet 42 with active developer solution, thereby avoiding resulting streaks or other forms of uneven development. Likewise, in order to provide optimum distribution of supporting fluid from fountain plate 34, fountain ports 35 communicating with channels 31, 33 are located in staggered relationship across the width of fountain plate 34. In addition to the staggered arrangement of the ports of spray pipes 36, 38, these pipes are positioned in manifold 39 such that cascading streams 46, 48 are at an angle to the perpendicular, preferably, but for the first spray pipe 36 encountered by sheet 42, facing in the direction of travel of sheet 42 in order to assist in the transport of the free, floating end of the sheet toward exit rollers 62, 64. The contra direction of the cascading spray of initial pipe 36, on the other hand, ensures the immediate immersion of the leading edge of sheet 42 beneath the surface of the standing head of developer solution and further causes a countercurrent flow of the solution to form a fluid wall at a nip dam area 49 through which sheet 42 must pass, thus ensuring rapid and complete contact between the developing fluid and the photographic composition of sheet 42.

Continuous circulation of fluid through the developer and rinse systems maintains a uniform concentration of developing and other chemical agents which may be dissolved in the processing solutions. Since fountain plates 24, 34 of the respective rinse and developing subassemblies 20, 30 are located in close proximity to the respective transport roller pairs 62, 64, the circulating fluid 47 flowing over the fore and aft ends of these fountain plates contacts at least lower rollers 64 and thereby maintains a thin coating of fluid on the rollers. This fluid layer serves to reduce any tendency of image film 42 to cling to rollers 62, 64 during the course of travel through the roller nips.

Upon entry of image sheet 42 into the first transport roller nip the sheet rides upon the surface of the developer fluid standing on fountain plate 34 until it encounters the counter-flowing cascade streams 46 which force the leading edge of sheet 42 beneath the level of the fluid head. Prior to its being forced by the cascade streams into direct contact with fountain plate 34, however, sheet 42 encounters the first line of fluid fountains 43 and, supported by their upward flow, proceeds, under the urging of first transport rollers 62, 64, beneath the next cascade streams 48. Being supported in turn by lines of fountains 44, 45 sheet 42 proceeds through further cascade streams 46, 48 to the exit nip of rollers 62, 64 which form a fluid dam area, such as at entrance nip 49, during exit of sheet 42. This exit nip additionally wrings most of the developer solution from the surface of the sheet as the latter passes on to rinse subassembly 20 where the rinsing process is carried out in similar manner.

Figure 6:
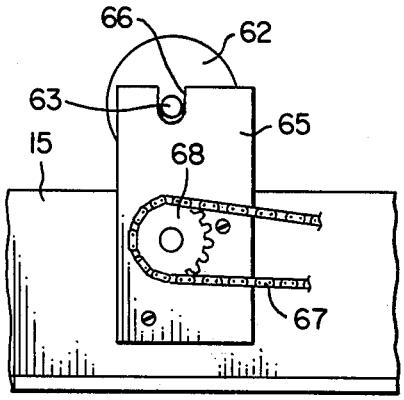
FIG. 6 is a partial side elevational view of the apparatus showing the transport roller drive and bearing arrangement.

Due to the constant fluid support of image sheet 42 provided by the action of fountains 43, 44, 45, as well as the downstream urging of the developer fluid cascading from the overhead spray pipes, the forward transport impetus provided by roller pairs 62, 64 need be minimal. These roller elements serve primarily to seal off the flow of fluid, as at 49, and to provide means for metering off or wringing the fluid from the surfaces of sheet 42. While represented generally as being of solid metal material, rollers 62, 64 may preferably be of tubular metal or light-weight plastic. Means for driving the transport roller pair 62, 64 is preferably as shown in FIG. 6 and comprises the driven rotation of lower roller 64, in the direction indicated, by means, for example, of chain 67 and sprocket 68, while roller 62 is driven only by frictional contact with roller 64 or the surface of sheet 42. The minimum of pressure contact between upper rollers 62 and the surface of image sheet 42 is also ensured by the floating action of axle 63 in a slotted bearing 66 in a bearing block 65 constructed, for example, of low-friction plastic material.

Considering the generally corrosive nature of the processing fluids employed in the developing apparatus, the various materials of which the subassemblies are constructed would normally be selected from plastics, such as polyvinyl chloride piping and conduits, and cast acrylic sheeting, as in the construction of the base and fountain plates. Other elements in the manufacture of the apparatus may be selected from a wide variety of plastics and non-corrosive metallic materials, such as stainless steel. Cartridge-type filters may be advantageously inserted in the course of flow piping 18, 19, and the supply tanks may be fitted with various fill and drain fixtures, and with immersion heaters to maintain desired temperature levels in the fluids.

The degree of force with which the cascading streams impinge upon the surface of image sheet 42 may, of course, be determined by the manufacturer; however, it has been found that sufficient and effective uniform distribution and agitation result from a substantially free fall gravity flow of the fluids. It has been found that the forceful direction of cascade streams upon the surface of wash-off photographic material can result in mechanical damage of the photographic composition surface, yielding uneven development and unsightly distortion of the photographic finish.

What is claimed is:

1. Photographic processing apparatus comprising:

(a) a reservoir for containing a supply of processing liquid;

(b) transport means situated above said reservoir and defining a substantially horizontal path of travel of sheet material in said apparatus, said transport means comprising:

(1) a flat, horizontally-disposed plate extending along said sheet travel path, (2) two pairs of superposed rollers extending transversely across said sheet travel path and situated adjacent to the respective proximal and distal ends of said plate, the nips of said roller pairs lying in a plane substantially parallel to the upper surface of said plate, (3) means for driving said rollers; and (4) liquid conduit means comprising a plurality of outlet ports terminating at said plate upper surface, said ports being arrayed transversely across said sheet travel path;

(c) processing liquid application means situated above said transport means plate and comprising liquid conduit means having a plurality of outlet ports arrayed transversely across said sheet travel path in at least two lines and positioned such that the ports of one line alternate transversely with those of the other line, and being spaced in said arrays such that the cumulative impingement pattern of liquid flow from said ports extends uninterrupted across said sheet travel path; and (d) means for circulating processing liquid from said reservoir simultaneously through said transport and application liquid conduit means, said liquid returning by gravity flow to said reservoir.

2. Apparatus according to claim 1 wherein said application means ports are aligned downwardly at an angle from the vertical with the linear array first encountered along said sheet travel path being aligned to direct liquid flow contra to the direction of said sheet travel.

3. Apparatus according to claim 2 wherein the remainder of said application means ports are aligned to direct liquid flow in said travel direction.

* * * * *